US007867078B2

(12) United States Patent
Duhamel

(10) Patent No.: US 7,867,078 B2
(45) Date of Patent: Jan. 11, 2011

(54) METHOD AND SYSTEM FOR PROVIDING A FEATURE GAME USING A COMPARISON PARAMETER

(75) Inventor: Gérald Duhamel, Drummondville (CA)

(73) Assignee: Labtronix Concept inc., Drummondville, QC (CA)

( * ) Notice: Subject to any disclaimer, the term of this patent is extended or adjusted under 35 U.S.C. 154(b) by 888 days.

(21) Appl. No.: 11/425,743

(22) Filed: Jun. 22, 2006

(65) Prior Publication Data

US 2007/0021174 A1 Jan. 25, 2007

Related U.S. Application Data

(60) Provisional application No. 60/693,107, filed on Jun. 23, 2005.

(51) Int. Cl.
*A63F 9/24* (2006.01)

(52) U.S. Cl. ..... 463/20; 463/21; 463/27

(58) Field of Classification Search ..... 463/12, 463/20, 16, 21, 27
See application file for complete search history.

(56) References Cited

U.S. PATENT DOCUMENTS 4,856,787 A * 8/1989 Itkis ..... 273/237
5,833,537 A * 11/1998 Barrie ..... 463/21
5,919,088 A 7/1999 Weiss
6,645,073 B2 * 11/2003 Lemay et al. ..... 463/20
6,656,040 B1 * 12/2003 Brosnan et al. ..... 463/16
2004/0209662 A1 10/2004 Wadleigh
2004/0242296 A1 12/2004 Nelson
2005/0277457 A1 * 12/2005 Wilson ..... 463/12
2006/0079316 A1 4/2006 Flemming et al.
2007/0298856 A1 12/2007 Gilmore et al.

FOREIGN PATENT DOCUMENTS

GB 2144644 A * 3/1985

* cited by examiner

*Primary Examiner*—Peter DungBa Vo
*Assistant Examiner*—Omkar Deodhar
(74) *Attorney, Agent, or Firm*—Benoît & Côté, s.e.n.c.

(57) ABSTRACT

In the application, embodiments for providing an interdependent combination of a primary game and a bonus feature are described. According to one embodiment of the invention, a method comprises the steps of conducting the primary game, conducting the bonus feature upon fulfillment of a triggering criterion, resuming conduct of the primary game upon fulfillment of primary-game ticket criterion with a bonus-feature resuming criterion being established during the conduct of the bonus feature, and resuming conduct of the bonus feature upon fulfillment of the bonus-feature resuming criterion. Between the times the primary game and the bonus feature are resumed, data relative to the bonus feature are maintained to permit resuming of the bonus feature in the state is was left. Embodiments of gaming machines, gaming devices, and game servers involved in providing embodiments of the invention are also described.

21 Claims, 9 Drawing Sheets

METHOD AND SYSTEM FOR PROVIDING A FEATURE GAME USING A COMPARISON PARAMETER

CROSS-REFERENCE TO RELATED APPLICATIONS

The present application claims priority of U.S. Provisional Patent Application 60/693,107 filed on Jun. 23, 2005 and entitled Method of Playing a Multi-step Bonus Game. The specification of the foregoing Provisional Application is hereby incorporated by reference.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
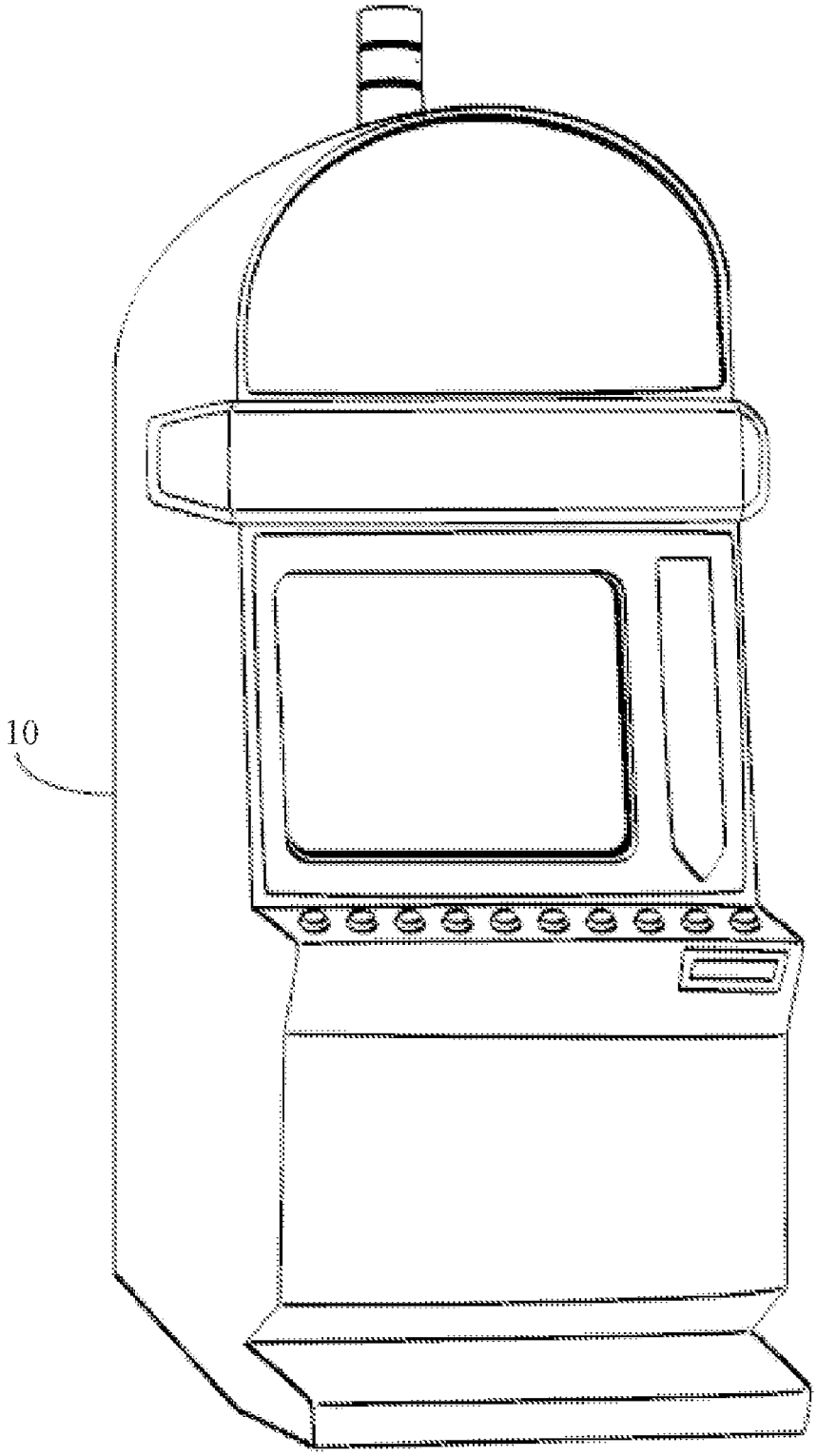
FIG. 1 is a schematic diagram showing a perspective view of a gaming machine according to an embodiment of the present invention.

An embodiment of the present invention provides a method for conducting an interdependent combination of a primary game and of a bonus feature. The method comprises steps involved in conducting the primary game and the bonus feature. Conducting the primary game comprises generating a primary game outcome; evaluating the primary game outcome against winning criteria and a triggering criterion; upon fulfillment of a winning criterion, assigning an award to the player; and upon fulfillment of the triggering criterion, initiating conduct of the bonus feature. Conducting the bonus feature comprises sequentially conducting bonus-feature processing steps; evaluating feature outcome resulting from these processing steps against a primary-game ticket criterion; and upon fulfillment of the primary-game ticket criterion, placing the bonus feature in a suspended state, storing bonus-feature data representative of the suspended state of the bonus feature, establishing a bonus-feature resuming criterion and resuming conducting the primary game. The method further comprises evaluating fulfillment of the bonus-feature resuming criterion when the bonus feature is in the suspended state to determine when to resume conducting the bonus feature according to the stored bonus-feature data.

Another embodiment of the invention provides for providing an interdependent combination of a primary game and a bonus feature to a player. The method comprises providing the primary game, comprising providing a primary game outcome; assigning an award to the player according to the primary game outcome; and signaling an initiation of the bonus feature upon a bonus-feature initiation criterion being fulfilled. The method comprises providing the bonus feature, comprising providing a bonus feature process resulting in a plurality of bonus feature outcomes, placing the bonus feature in a suspended state when a feature outcome fulfills a primary-game ticket criterion; signaling a bonus-feature resuming criterion to the player; and resuming providing the primary game. The method further comprises resuming the bonus feature upon fulfillment of the bonus-feature resuming criterion in the primary game.

Another embodiment of the invention provides a gaming device for providing an interdependent combination of a primary game and a bonus feature to a player. The gaming device comprises input-receiving means for receiving player inputs; displaying means for displaying information regarding at least one of the primary game and the bonus feature; and controlling means for controlling providing of the primary game and the bonus feature on the displaying means according to player inputs. The controlling means is adapted for providing a primary game outcome; assigning an award to the player based on the primary game outcome; evaluating fulfillment of criteria; signalling the initiation of the bonus feature upon a bonus-feature initiation criterion being fulfilled; providing a bonus feature process resulting in a plurality of feature outcomes; maintaining the bonus feature in a suspended state upon fulfillment of a primary-game ticket criterion in the bonus feature; signalling a bonus-feature resuming criterion; and resuming providing the primary game to the player with the bonus feature remaining in a suspended state until fulfillment of the bonus-feature resuming criterion.

Another embodiment of the invention is provided through a game server for controlling conduct of an interdependent combination of at least one primary game and a bonus feature on at least two distinct gaming devices. The game server comprises communicating means for communicating signals to the gaming devices; and controlling means for controlling conduct of the bonus feature. The controlling means is adapted for transmitting a bonus-feature initiation signal to at least one gaming device which initiate the conduct of the bonus feature; transmitting bonus-feature data when one gaming device initiates conducting the bonus feature or resumes conducting the bonus feature; and maintaining bonus-feature data relative to the conduct of the bonus feature. The interdependent combination of at least one primary game and bonus feature is configured for the bonus feature being capable of becoming in a suspended state with a gaming device suspending conducting the bonus feature based on a feature outcome in the bonus feature and the gaming device resuming conducting the bonus feature based on a feature outcome that occurred during its last conduct of the bonus feature In relation with the present application, the terms criterion and criteria mean a state which may be evaluated in the environment related to embodiments of the invention. Accordingly, criteria may comprise outcomes; single or combination of indicia in view of or regardless of an indicia configuration; combination of outcomes; states being capable to be fulfilled in regard of a single outcome, or states being capable of being fulfilled or necessitating to be fulfilled a plurality of game outcomes; signals received from a communicatively-linked device, or game-related monitored data.

Primary game means a game using means to provide an outcome to a player, the outcome being evaluated against one or more winning criteria to determine if, for example, a prize value should be awarded to the player. Accordingly, the outcome may be a value, a combination of indicia, etc. It may be randomly generated, retrieved from a pool, or any other generated according to any other suitable process. The outcome may further be generated on the same device that provides the outcome to a player, or may remotely controlled and/or generated, and communicated to a device providing the outcome to a player.

In relation with embodiments of the invention, outcome means the result of a game process, which, on its own or compared with criteria, results in a useful value (such as a prize being awarded or not to a player). Examples of outcomes comprise the cards resulting from a poker game play; one, some or all of the game indicia displayed once the reels stop in a line game; and the daubing-pattern generated on a card by the daubing of the numbers matched in a bingo game.

Bonus feature means any suitable process which, following its initiation, provides a player with a game being conducted with a plurality of feature outcomes resulting from different intermediary states in the bonus feature from the initiation to its conclusion. Accordingly, the bonus feature may take many forms involving either or not player actions, random determinations, and prizes or other awards that may be awarded to the player as examples.

Figure 2:
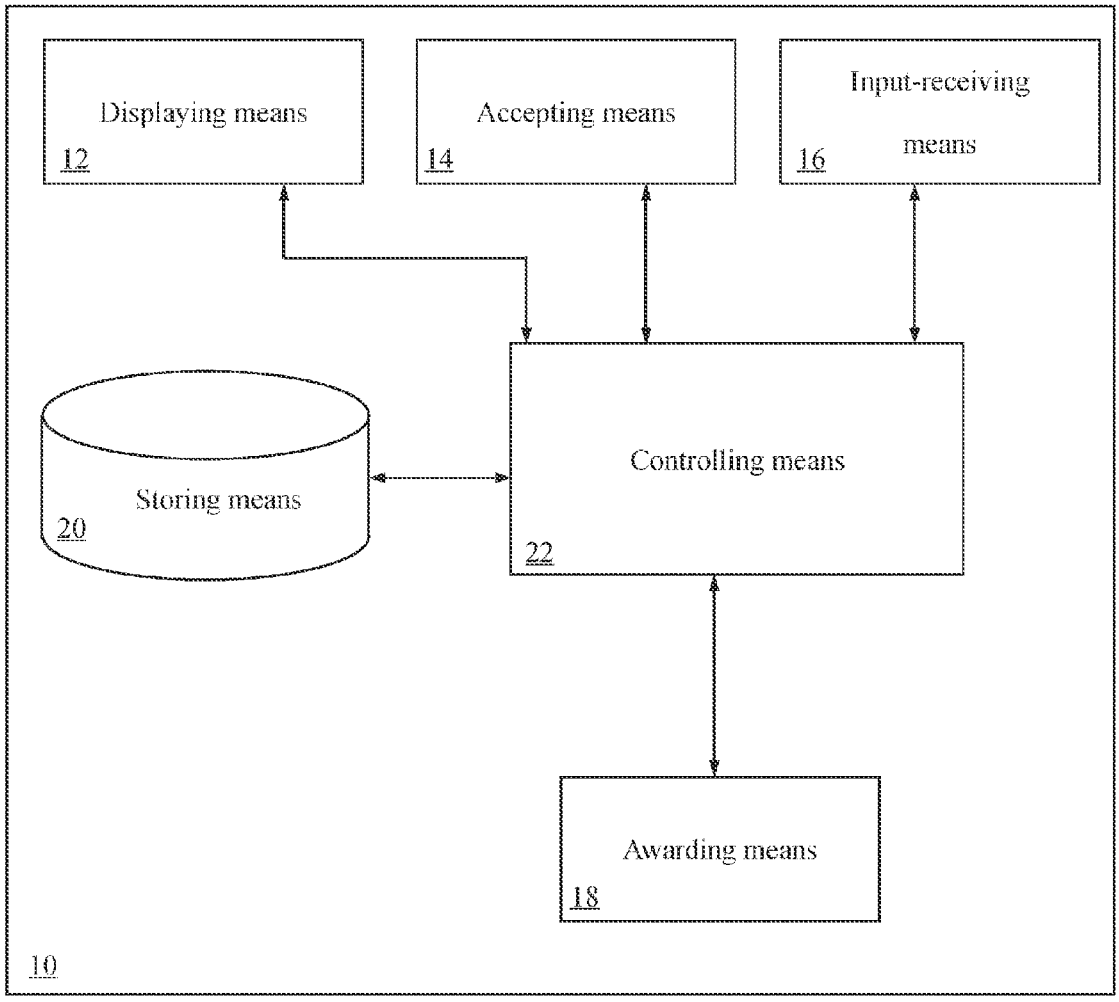
FIG. 2 is a bloc diagram illustrating the components of the gaming machine of FIG. 1.

Embodiments of the present invention may be carried out on a gaming machine, as illustrated in FIGS. 1 and 2. Said gaming machine 10 comprises displaying means 12, such as a video screen, a LCD screen or mechanical reels; accepting means 14 such as a card reader, or a coin and/or bill acceptor; input-receiving means 16, such as buttons, levers or a touch screen; awarding means 18, such as a ticket printer, a card reader or a hopper; storing means 20 such as RAM, flash memory, a hard drive or a removable memory medium, and controlling means 22 such as a computer, computer codes, or a hardware controller. In another embodiment, the gaming machine 10 carrying out the invention may comprise, either in replacement of or in combination with the accepting means 14, communicating means 28 allowing communication between the controlling means 22 and a remotely linked accounting means (not shown) wherein player accounts are maintained, and credits are downloaded on the gaming machine 10 and uploaded on the accounting means when appropriate; the downloaded credits being used by a player on the gaming machine 10.

Figure 3:
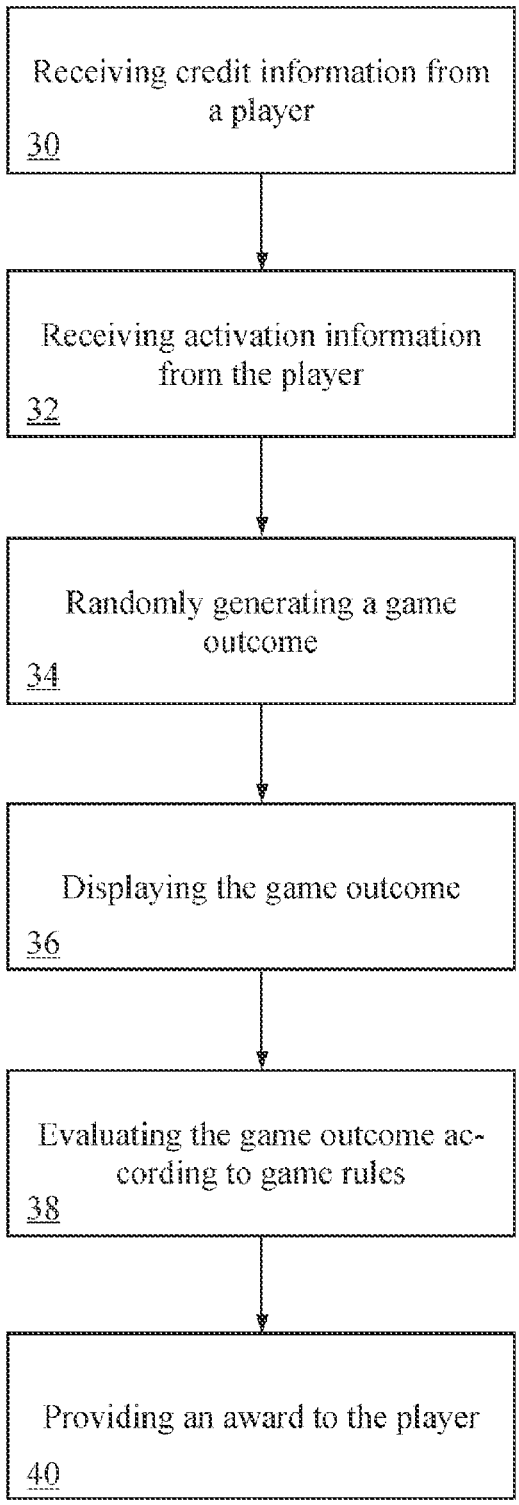
FIG. 3 is a flowchart illustrating the steps for a game process as played on the gaming machine of FIGS. 1 and 2.

Said gaming machine 10 is designed, as shown on FIG. 3, to receive credit information from a player (step 30) either in a physical format (such as coins or bills) or in an electronic format (such as a player card or a money transfer from a bank account), to receive activation information from the player (step 32), to randomly generate (step 34) and display (step 36) a game outcome, to evaluate said game outcome according to game rules (a pay schedule for example) (step 38), and to award a prize to the player for a winning game outcome (step 40).

Figure 4:
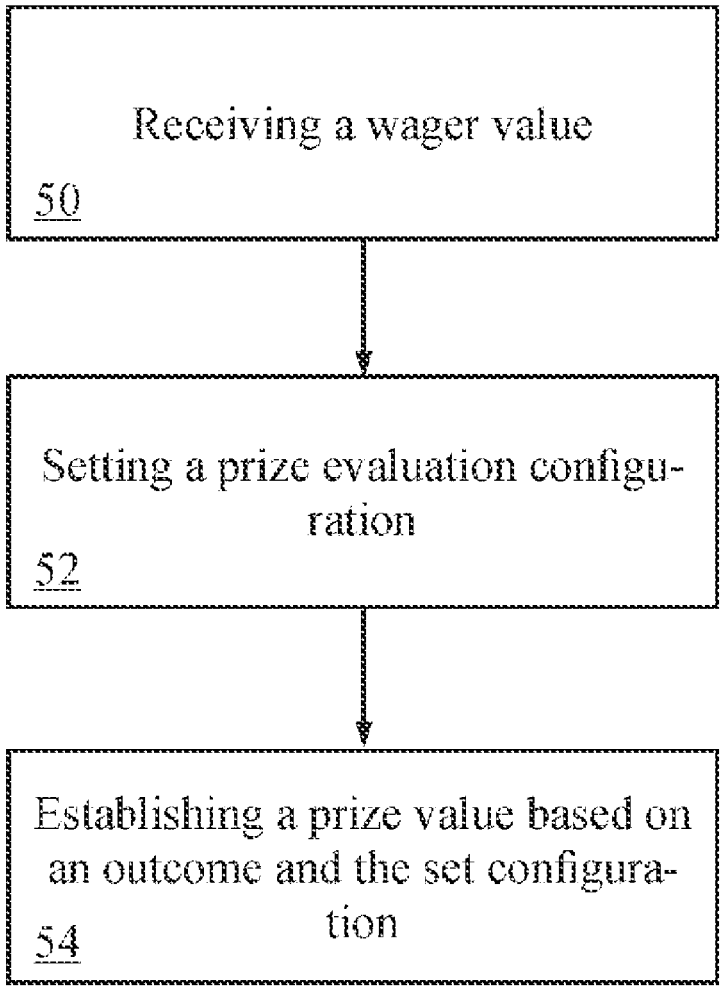
FIG. 4 is a flow chart illustrating steps involved in a prize determination process as performed on the gaming machine of FIGS. 1 and 2.

Said gaming machine 10 is designed, according to embodiments as shown on FIG. 4, to receive a wager value from the player (step 50); to set up a prize evaluation configuration based on the received wager value (step 52); and upon fulfillment of a winning criterion, to assign a win value according to the set prize evaluation configuration to the player (step 54). According to embodiments, examples of prize evaluation configurations comprise—a particular pay schedule;—a pay schedule, in, for example, a poker game, with a qualification to win a progressive prize upon the wager value being set to a maximum value;—a configuration of active pay lines and pay-line wagers in a line game, and—a pay schedule with winning configurations or bonus triggering configurations being activated upon the wager value reaching a threshold value (also called a buy-in process).

Embodiments of the invention may also be carried out on a gaming device (not shown) performing more or less autonomously processes related to providing a player with either one of the primary game and the bonus feature. For example, the gaming device may be in communication with a game server (not shown) which provides the gaming device with an outcome, or other information necessary for the gaming device i) to provide representations of the conduct or ii) to conduct at least one of the primary game or the bonus feature. The gaming device may also, for example, generate data used for representing outcomes to the player, evaluate criteria fulfillment, or exchange signals relative to criterion fulfillment with the game server.

Therefore, embodiments of the invention may also be carried out in part on a game server in communication with a gaming device as described above. That server may, in these embodiments, communicate signals related to the conduct of the primary game or the bonus feature. The game server may monitor data related to embodiments of the invention. It may also perform determination functions or evaluation functions in relation with embodiments the invention.

Figure 5A:
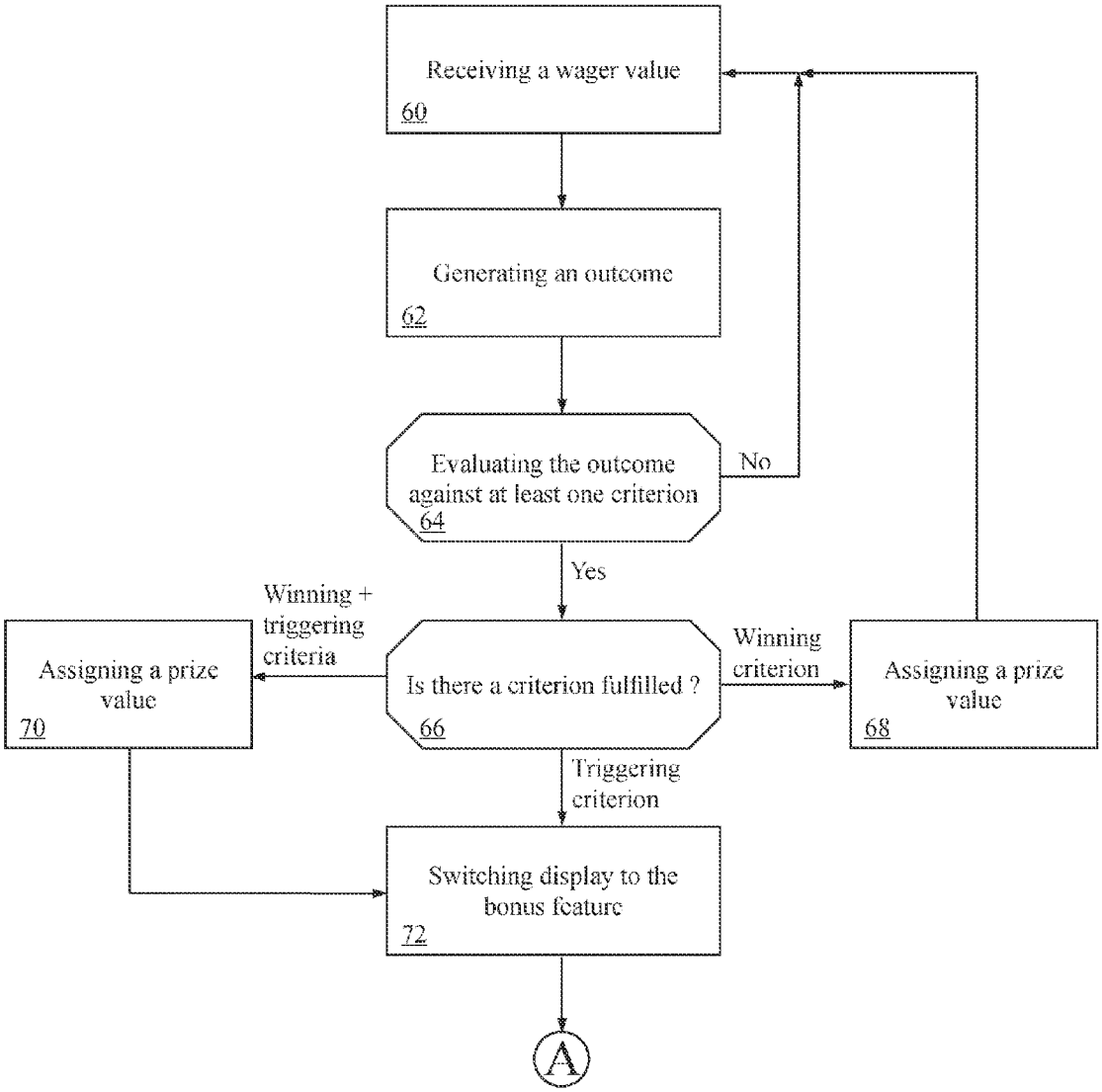
FIGS. 5*a, b, c* represent a flow chart illustrating steps according to one embodiment providing an interdependent combination of a primary game and a bonus feature.
Figure 5B:
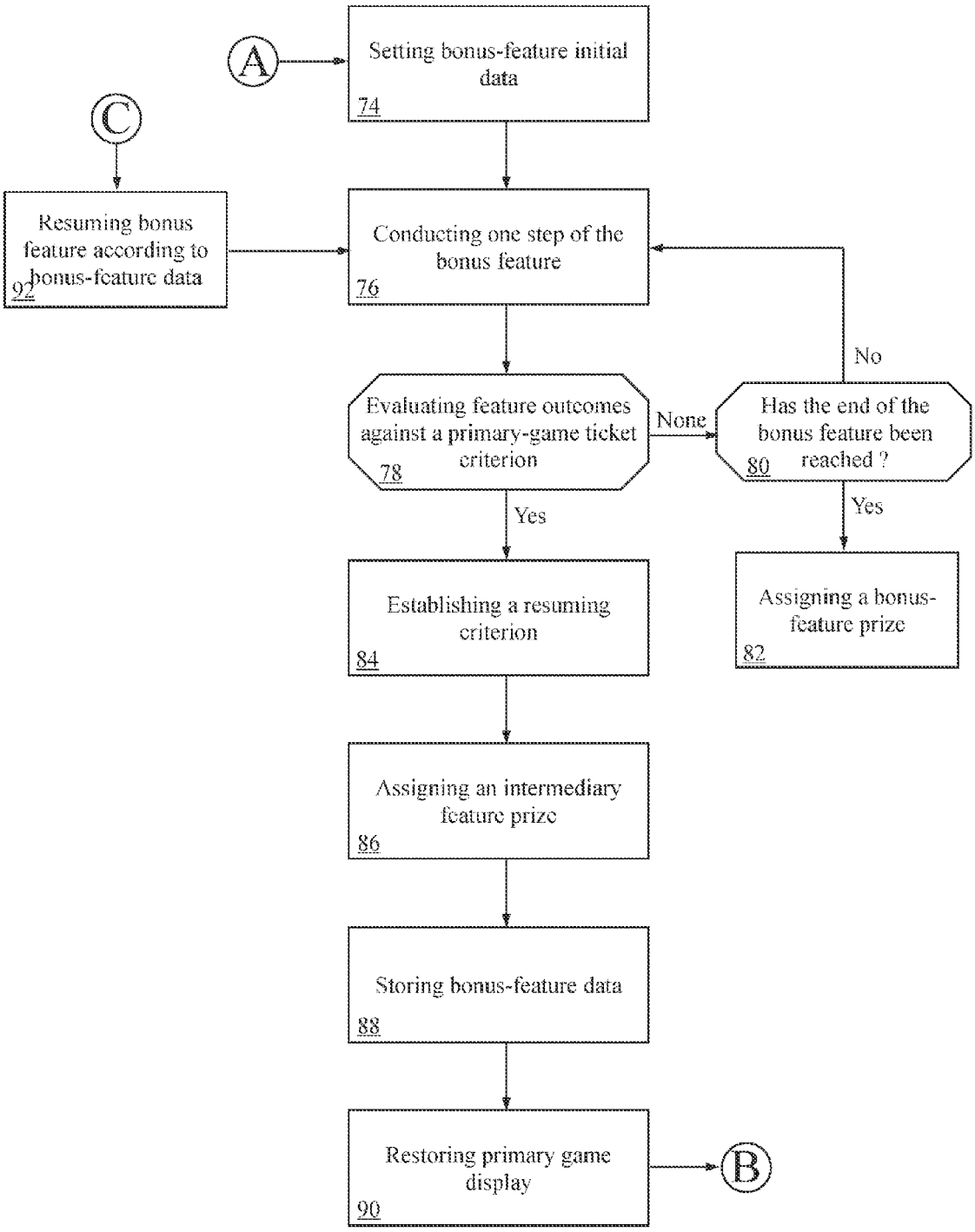
Figure 5C:
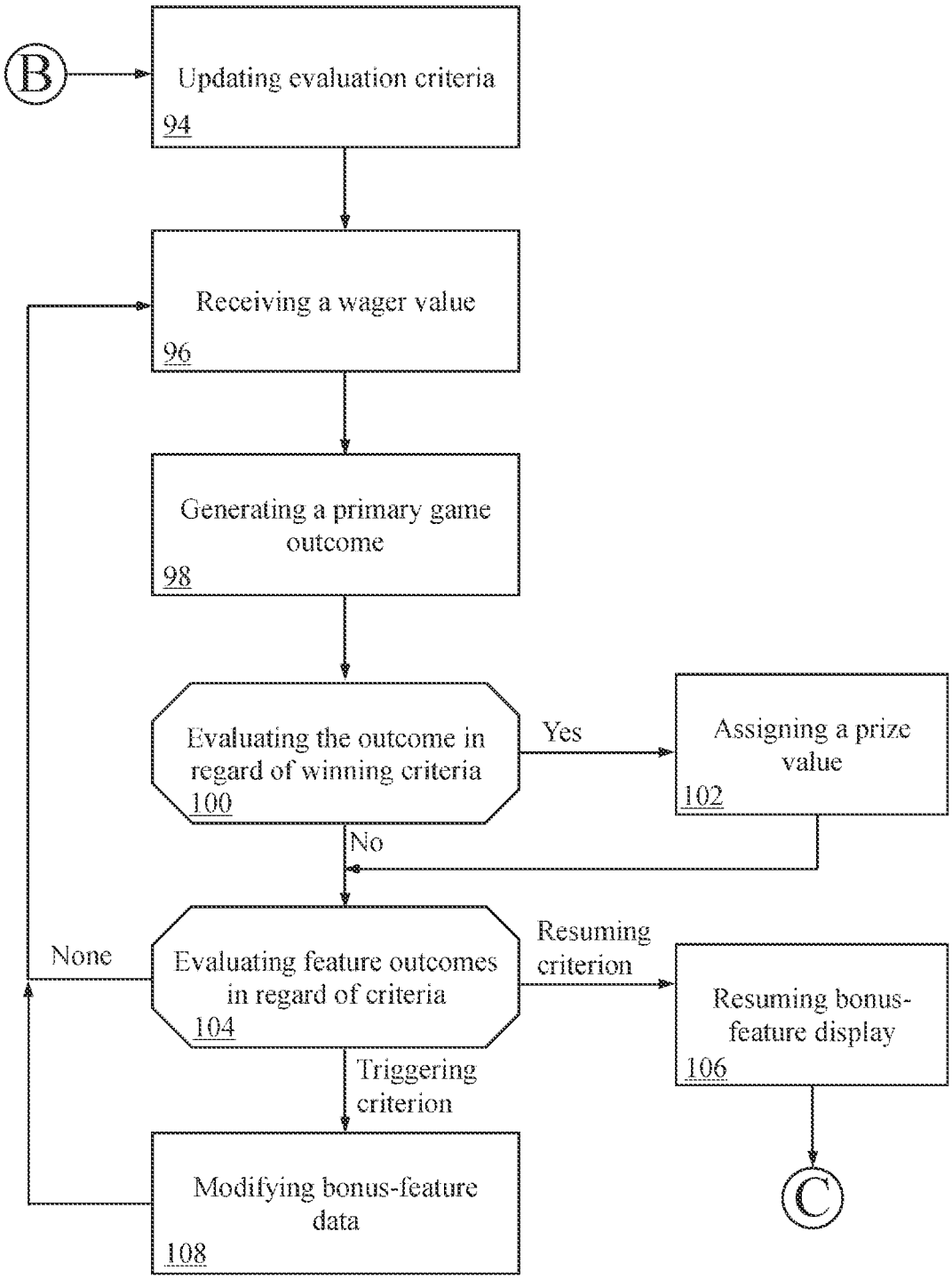

An embodiment of the invention may be provided as a method of conducting an interdependent combination of a primary game and a bonus feature. The method may be divided in blocks: steps involved in conducting the primary game (illustrated particularly on the flow charts of FIGS. 5*a* and 5*c*), and steps involved in conducting the bonus feature (illustrated on flow chart of FIG. 5*b*).

The conduct of the primary game comprises receiving a player's wager (step 60), generating a primary game outcome (step 62), evaluating the primary game outcome against criteria (step 64) with no criteria being fulfilled resulting in the underlying game being resumed at the wagering step (step 60). When a winning criterion is fulfilled according to the evaluation (step 66), a prize may be awarded to the player (step 68) followed with the primary resuming to the wagering step (step 60). If both a winning criterion and a triggering criterion are fulfilled (step 66), the player is awarded a prize (step 70) and the game representation switches to the bonus feature (step 72). If only the triggering criterion is fulfilled (step 66), the game representation switches to the bonus feature (step 72).

Upon initiation of the bonus feature, data regarding the play of the bonus feature is established (step 74), following with the beginning of the conduct of the bonus feature (step 76). According to this embodiment, the bonus feature conduct presents multiple steps with the conduct of each step providing a feature outcome. These feature outcomes are evaluated against a primary-game ticket criterion (step 78). If the primary-game ticket criterion is not fulfilled, the bonus feature is evaluated to determine if an ending criterion has been reached (step 80). Upon the reaching of that ending criterion, the player is awarded a bonus prize according to the conduct of the bonus feature (step 82). If the primary-game ticket criterion is fulfilled, a bonus-feature resuming criterion is established for the primary game (step 84) followed with the player being awarded a bonus-feature intermediary prize (step 86) when appropriate. The current feature-game data is stored (step 88) to resume the bonus-feature conduct in the same state it is left in, and the game representation switches back to representation of the primary game (step 90).

When the bonus feature is began, the primary game conduct comprises updating the evaluation criteria (steps 94) with the bonus-feature resuming criterion and above provided steps of receiving a player's wager (step 96) and generating a primary game outcome (step 98). It further comprises evaluating the outcome against a winning criterion (step 100) with a prize value being awarded accordingly (step 102), and evaluating the outcome against triggering and bonus-feature resuming criteria (step 104), the first being potentially followed with a modification of the bonus-feature data (step 108) while the second being followed with the bonus feature being resumed and displayed back to the player (step 106). If the bonus-feature resuming criterion is not fulfilled, the primary game is resumed back to the wagering step (step 96). When resumed, the bonus feature is restored to the game state it was when left (step 92) unless the bonus-feature was modified, following with the conduct of at least one further step in the bonus feature (step 76).

Therefore, a process wherein a primary game and a bonus feature are interdependently conducted is provided, with at least one criterion regarding the conduct of the primary game (e.g. the bonus-feature resuming condition in the provided embodiment) being established during the conduct of the bonus feature occurring before the resuming of the primary game.

Figure 6:
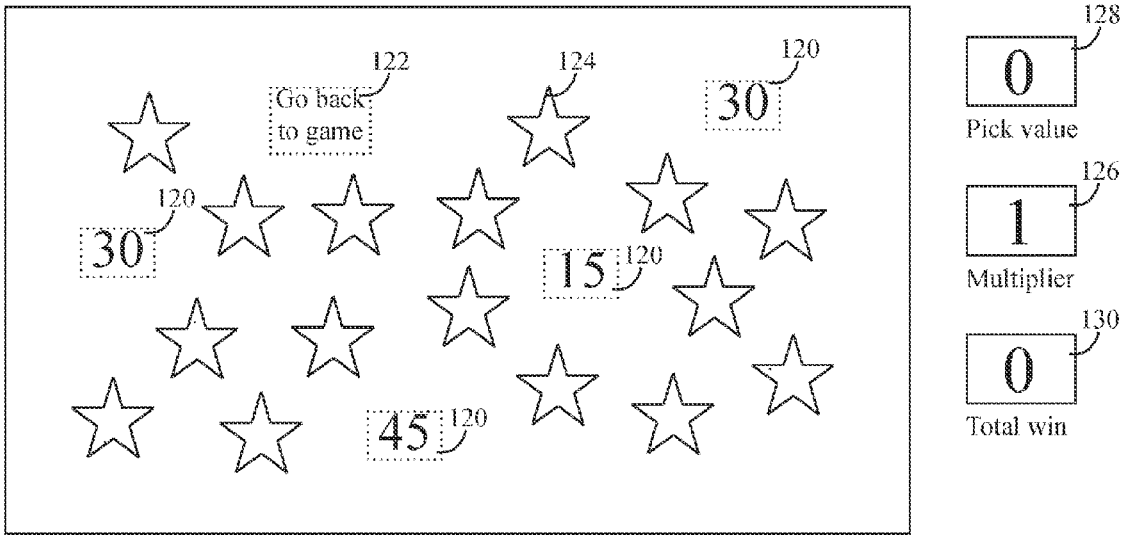
FIG. 6 is a representation of a bonus feature in process according to an embodiment of the invention.

An example of the above embodiment comprises a primary game being a line game and bonus feature presenting a plurality of object selections to receive from the player. In the line game (thus scattered), upon occurrence of an outcome comprising at least four BONUS symbols disposed anywhere in the outcome, the bonus feature is initiated. At the beginning of the bonus feature, the player is provided with a representation of twenty (20) selectable objects, each having a hidden associated value. Among the selectable objects are two (2) objects for which the selection takes the player back to the primary line game for a random number of spins. Before taking the player back to the line game, two virtual die are tossed with the toss outcome determining the number of spins to take place in the line game before resuming the bonus feature. After the player completes the required number of spins in the line game, the bonus feature is resumed in the state it was left in. In the present example, as illustrated on FIG. 6, during his first access to the bonus feature, the player selected four (4) value-associated objects 120 before selecting the object having an associated primary-game ticket value 122. Therefore, after the necessary number of spins in the line game, the bonus feature resumes with fifteen (15) remaining selectable objects 124. The player, following the second bonus-feature access, continues selecting objects until selection of the second primary-game-ticket associated object which, since it is the second one selected, ends the bonus feature. In the present example, a multiplier counter 126 is activated when the player accesses the bonus feature for the second time. Each time the value associated with a selected object matches one already revealed value, the multiplier counter increases by one unit. Upon selection of the primary-game-ticket associated object, the value resulting from the sum of the values revealed following the second access to the bonus feature, illustrated on the pick value counter 128, is multiplied by the multiplier-counter 126 value and the player is awarded the resulting product provided on through the award counter 130.

In another example of the same embodiment, the primary-game-ticket associated objects have already a number of spins assigned. Therefore, the player, by selecting the object with its value being revealed, automatically knows the number of spins to perform in the line game. Furthermore, during these spins, if an outcome of four (4) or five (5) BONUS symbols occurs, the bonus feature state is reset to a new set of twenty selectable objects, resulting in the selection of a primary-game-ticket associated object following the subsequent bonus-feature access triggering additional spins in the line game.

In another example of the same embodiment, the values of primary game tickets used to establish the bonus-feature resuming criteria are outcomes that will be monitored in the primary game. In an example, the primary-game-ticket value is a combination of two BONUS symbols and two times. Though, the bonus feature resumes as soon as two primary-game outcomes comprising at least two BONUS symbols are monitored in the primary game in this example.

Figure 7:
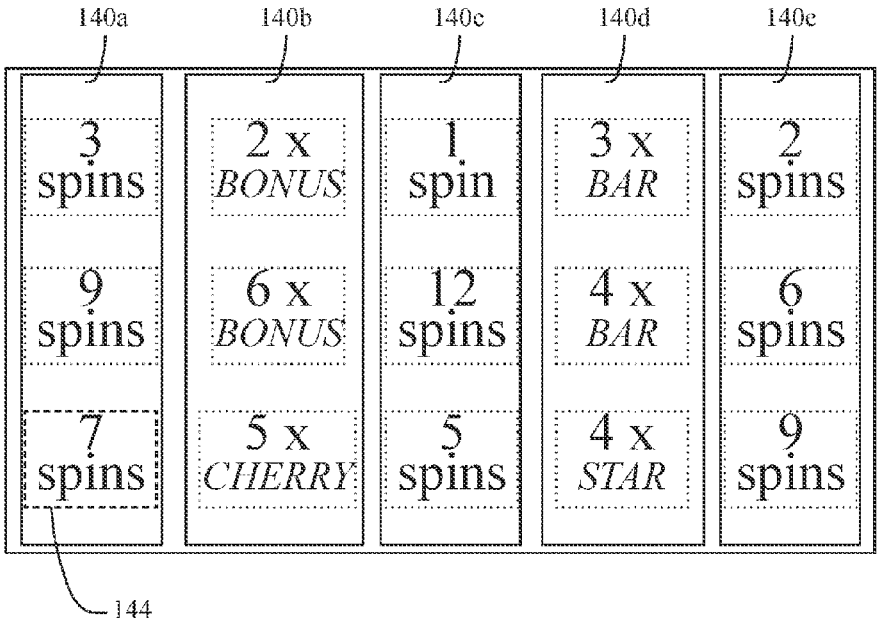
FIG. 7 is a representation of a particular feature of a bonus feature in process according to another embodiment of the invention.

In another example of the same embodiment, the selection of a primary-game-ticket associated object results in the player accessing a resuming-criterion table. In this table, the player is provided five (5) groups 140 as illustrated on FIG. 7. Three (3) groups 140*a,c,e* present each three (3) distinct number of spins. Two (2) groups 140*b, d*, each presents three (3) symbol combinations. The player selects one group 140*a*, with a random determination of one particular element 144 of the group being performed afterwards. This particular element determines the bonus-feature resuming criterion used to determine when to resume the bonus feature. The figure illustrates selection of the second group by the player with random determination of the first element of that group: seven (7) spins.

In another embodiment, the player is provided with a number of picks upon initiation of the bonus feature with which to the player performs selections. Upon selection of a primary-game-ticket associated object, the primary game is resumed. The bonus feature ends when the number of picks is used up to select objects.

In relation with the above embodiments, different primary-game outcomes may influence the bonus feature when in a suspended state. For example, the occurrence of the primary-game outcome fulfilling the triggering criterion may cause the bonus feature to offer at least one of: more selectable objects, modification in the number of picks the player may use in a selection game, modification in the value associated with the objects, new values associated with objects such as multiplier values, modification in the number of objects associated with primary-game tickets, modification of the number of spins associated with primary-game-ticket associated objects, enabling of triggers allowing access to other bonus features or bonus-feature levels, etc.

In another embodiment of the invention, the primary game is blackjack, with the occurrence of a pair as an initial hand matching the initial dealer-revealed card triggering access to the bonus feature. The bonus feature is a line game which lasts for a predetermined period of eight (8) spins. In the line game, a scatter combination of any four (4) identical symbols takes the player back to the primary game until fulfillment of the bonus-feature resuming criterion determined by the symbols participating in the scatter combination. Examples comprise LOOSE symbols with a loose criterion being determined, a particular sum (e.g. 20, 10 or less, over 18) as the applied criterion, etc. In the present example the determined bonus-feature resuming criterion is a push outcome. If the bonus feature is re-triggered during the primary game (fulfillment of the bonus-feature triggering criterion), the symbols borne by the reels in the line game are modified to increase the probability of occurrence of big prizes and two (2) additional spins are given to the player. Upon occurrence of a second feature-game triggering outcome, four (4) additional spins are given to the player, and so on. Upon occurrence of an outcome fulfilling the bonus-feature resuming criterion, the player resumes the bonus feature with the remaining number of spins. Upon exhaustion of all spins, the bonus feature ends and the player is taken back to the primary game for good.

Figure 8:
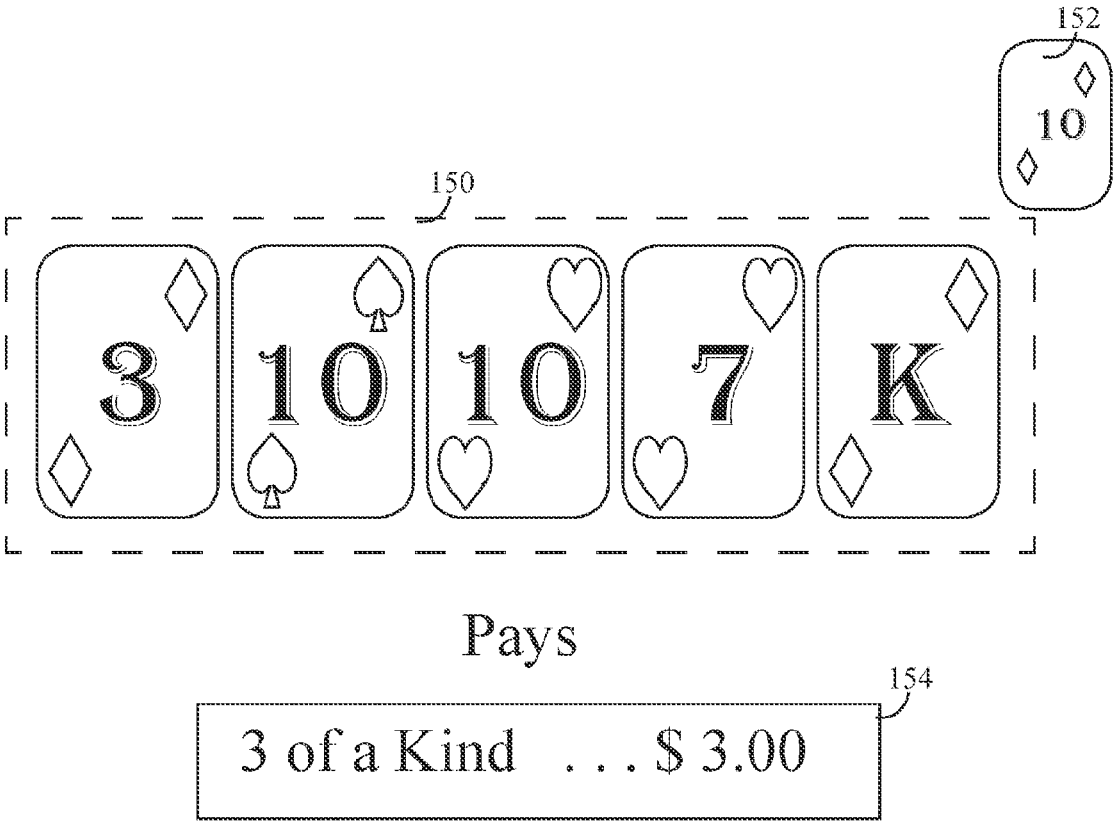
FIG. 8 is a representation of a primary game in progress according to an embodiment of the invention.

In another embodiment, the primary game is a poker game. Upon reception of a triggering signal from a communicatively-linked server, the gaming machine on which the poker game is played modifies the displayed game to present a selection bonus feature. In the bonus feature, fifteen (15) selectable objects are displayed with two (2) of them hiding a card. The player has initially five (5) picks. Upon selection of an object associated with a card, a random number of hands are determined. In this example, the random number is two (2) and the revealed card is the Ten of Diamonds. Following, the poker game is resumed with the Ten of Diamonds being a sixth card in the game. Accordingly, such as illustrated on FIG. 8, during each of these two rounds of poker, the player receives five (5) cards, selects cards to discard and receives replacement cards, a final five-card hand 150 is established and a best five-card poker hand is evaluated based on the final five (5) cards 150 plus the Ten of Diamonds 152. FIG. 8 illustrates the outcome of one of these two poker game rounds. The outcome paid to the player is a Three-of-a Kind ranking outcome 154 since the five-card hand 150 comprises a pair of Ten's.

In another embodiment, the primary game in a line game wherein, upon fulfillment of a triggering criterion, a bonus feature is provided. In the bonus feature, the player is provided with an offer he may refuse or accept. The offer is composed of a prize value and of a bonus-feature resuming criterion. If the player refuses the offer, the criterion is placed in bank and the player is provided with a new offer. If the player accepts an offer, the player is awarded the offer value, and a bonus-feature resuming criterion is set based on the accepted offer and the in-bank criterion. For example, if the in-bank criterion is three (3) spins in the line game and the accepted-offer criterion is a four (4) BONUS-symbols outcome, the resulting bonus-feature resuming criterion may demand fulfillment of both criteria. When the primary game is resumed, the criteria resulting from the offer-acceptance process are used in the primary game. Thus, the bonus feature is resumed with the fulfillment of the last of the two criteria. The bonus feature ends with the first of i) three (3) offers being accepted by the player, or ii) when a total of seven (7) offers has been provided to the player.

In another embodiment of the invention conducted in a networked fashion, the embodiment is carried out on networked gaming machines communicating with a server. A maximum of ten (10) players plays the same primary game each on their own gaming machine. The server monitors the wagers of the different players, and upon the sum of the monitored wagers increasing to a randomly set value, the active gaming machines receive a bonus-feature triggering signal and provides a representation of the bonus feature. In the bonus-feature, the players are prompted to pick a card from thirteen hidden-value cards having values ranging from Two to Ace. Each participating player is displayed the card value of the other bonus-feature participating players without seeing his own selected-card value. Each player is then required to guess if his own card value is in the high portion or low portion of the selected card values during a predetermined response period. Players, who provided a right guess and therefore qualify in the bonus feature, are set a bonus-feature resuming criterion, and they resume play of the primary game until fulfillment of that criterion. When a qualified player succeeds to fulfill the bonus-feature resuming criterion, he is invited to participate in a common selection feature, i.e. a second level of the bonus feature. Qualified players participate in the common bonus feature as they succeed to fulfill their bonus-feature resuming criterion, with the players being provided a representation of the bonus feature in a state representative of the previous players' participations in the common bonus feature. Players continue participating in the common bonus feature until either they are disqualified or until the bonus feature ends. When the bonus feature ends, the bonus-feature resuming criteria are deactivated for all remaining qualified players. The player who ended the common bonus feature is awarded a complimentary prize.

Even if above embodiments presents awarding prizes to players in relation to the primary game or the bonus feature, other forms of rewards may also be used. Examples of such alternative rewards may comprise: points, participations in features, non-cashable credits, progressive prizes, gifts, vouchers redeemable in multiple forms, and comps.

The time at which the awards are provided to the player may also vary. These awards may be provided upon their occurrence, they may be accumulated before being provided, the providing may be delayed to the occurrence of a particular event or upon reach of a particular state (e.g. play of the primary game until the bonus feature being resumed), or may even be risked according to game play.

The nature of the primary games and the bonus features may also vary. Some examples of primary have been provided, but any primary game providing suitable characteristics are meant to be comprises within the scope of the invention. If the primary game does not provide all the necessary characteristics, a combination of the primary game and of the gaming environment in which the game is provided may provide these necessary characteristics.

Similarly, the bonus feature may take many forms. Available forms comprise processes involving interaction from player such as selection features and poker games, random processes such as line games and wheel-turning process, evolving processes such as board-like games, risk-game processes such as offer-and-acceptance-bonus-scheme processes (e.g. a value being offered to the player and the player either accepting the value of refusing the value to be awarded a replacement value), or any other suitable processes wherein a suitable condition may be established to resume the bonus feature.

The fashion in which the primary game and the bonus feature are provided to the player, and the nature of the device (s) carrying out the invention may also vary. An example of available variations comprises a gaming machine comprising a primary-game dedicated first displaying means, and a bonus-feature dedicated second displaying means. When no bonus feature is in process, the second displaying means provides generic information, and advertisement information. However, when a bonus feature is initiated, the second displaying means provides a representation of the bonus feature with modification according to its conduct. Representation of the bonus feature remains active on the second displaying means until the end of the bonus feature. Another example may be a gaming device depending in part on signals from a server to provide the primary game and/or the bonus feature.

While illustrated in the block diagrams as groups of discrete components communicating with each other via distinct data signal connections, it will be understood by those skilled in the art that embodiments capable of carrying out the invention may be provided by a combination of hardware and software components, with some components being implemented by a given function or operation of a hardware or software system, and many of the data paths illustrated being implemented by data communication within a computer application or operating system. The structure illustrated is thus provided for efficiency of teaching suitable embodiments.

It should be noted that the present invention can be carried out as a method, can be embodied in a system, a computer readable medium, processor-readable memory or an electrical or electro-magnetic signal.

The embodiments of the invention described above are intended to be exemplary only. The scope of the invention is therefore intended to be limited solely by the scope of the appended claims.

I claim:

1. A method for conducting, on a gaming apparatus, an interdependent combination of a primary game and a bonus feature, the method comprising the steps for:

conducting on the gaming apparatus the primary game, comprising:

generating a primary game outcome;

evaluating the primary game outcome against winning criteria and a triggering criterion;

upon fulfillment of one of the winning criteria, assigning an award to a player; and upon fulfillment of the triggering criterion, placing the primary game in a suspended state and initiating conduct of the bonus feature, while otherwise resuming conduct of the primary game, and the step for:

conducting on the gaming apparatus the bonus feature, comprising:

conducting bonus feature in a plurality of processing steps to provide a plurality of feature outcomes;

evaluating said feature outcomes resulting from the bonus-feature processing steps against a primary-game ticket criterion;

upon fulfillment of the primary-game ticket criterion, placing the bonus feature in a suspended state, storing bonus-feature data representative of the suspended state of the bonus feature, establishing a bonus-feature resuming criterion, and resuming conduct of the primary game, wherein the conduct of the resumed primary game after being resumed during the conduct of the bonus feature comprises the steps of:

generating a resumed primary game outcome;

evaluating the resumed primary game outcome against the winning criteria and the bonus-feature resuming criterion; and upon fulfillment of one of the winning criteria, assigning an award to a player; and upon fulfillment of the bonus-feature resuming criterion, resuming conducting the bonus feature according to the stored bonus-feature data, thereby continuing conducting the bonus feature in regard of the already-conducted processing steps.

2. The method of claim 1, wherein the step of conducting the primary game further comprises:

receiving a wager value;

establishing an outcome evaluation configuration based on said wager value; and establishing a prize value to assign to the player based on said generated primary game outcome and the established outcome evaluation configuration.

3. The method of claim 1, wherein the step of conducting the primary game when the bonus game is in a suspended state comprises:

evaluating the resumed primary game outcome against the triggering criterion; and upon fulfillment of the triggering criterion, modifying the stored bonus-feature data.

4. The method of claim 3, wherein the step of modifying the bonus-feature data comprises at least one of:

increasing duration of the bonus feature;

increasing values associated with the bonus feature; modifying conduct rules of the bonus feature;

modifying characteristics of components participating in the conduct of the bonus feature; and modifying values of components participating in the conduct of the bonus feature.

5. The method of claim 1, wherein the step of conducting the bonus feature comprises the steps of:

receiving a selection from the player; and establishing a feature outcome at least in part based on said selection.

6. The method of claim 1, wherein the step of conducting the bonus feature comprises the step of establishing at least one invited player for whom is conducted the bonus feature, wherein the invited player is playing a game on a gaming machine on which no triggering criterion is fulfilled.

7. The method of claim 1, wherein the step of conducting the bonus feature comprising the steps of:

evaluating the feature outcome in regard of a feature-ending criterion; and deactivating said bonus-feature resuming criterion upon fulfillment of the feature-ending criterion.

8. The method of claim 1, wherein the step of conducting the bonus feature comprises the step of: assigning a bonus award to the player based on at least one of said feature outcomes.

9. The method of claim 1, wherein the step of establishing a bonus-feature resuming criterion comprises at least one of (a) performing a random process; and (b) receiving a selection from a player, wherein said step of performing a random process or said step of receiving a selection is used in said step of establishing a bonus-feature resuming criterion.

10. The method of claim 1, wherein the step of evaluating the resumed primary game outcome against the bonus-feature resuming criterion comprising monitoring occurrence at least one of: (a) a number of at least two primary game outcomes; (b) a number of at least one primary game outcome fulfilling a predetermined criterion; and (c) data related to the primary game but unrelated the primary game outcome.

11. The method of claim 1, wherein the step of conducting the resumed primary game further comprises the step of modifying a configuration of the primary game based on at least one of said feature outcomes.

12. The method of claim 1, wherein the step for conducting the bonus feature comprises conducting the processing steps according to rules of at least one of: poker, blackjack, line game, selection process, and an offer and acceptance process.

13. The method of claim 1, wherein the step for conducting the primary game further comprises establishing a primary game outcome based on rules associated with at least one of: poker, blackjack, bingo, keno, and line game.

14. A method for providing, on a gaming apparatus, an interdependent combination of a primary game and a bonus feature to a player, the method comprising:

the steps for providing the primary game, comprising:

providing, on the gaming apparatus, a primary game outcome to the player;

assigning an award to the player according to the primary game outcome; and placing the primary game in a suspended state and signaling an initiation of the bonus feature upon a bonus-feature initiation criterion being fulfilled;

the steps of providing the bonus feature, comprising:

providing, on the gaming apparatus, a bonus feature process resulting in a plurality of feature outcomes;

placing the bonus feature in a suspended state when a feature outcome fulfills a primary-game ticket criterion;

signaling a bonus-feature resuming criterion to the player; and resuming providing the primary game, and the steps for providing the resumed primary game when the bonus feature is in a suspended state, comprising:

providing, on the gaming apparatus, a resumed primary game outcome to the player;

assigning awards to the player according to the resumed primary game outcome; and resuming providing the bonus feature upon a bonus-feature resuming criterion being fulfilled.

15. The method of claim 14, wherein the steps for providing a primary game outcome or feature outcomes comprises at least one of:

generating said outcomes;

providing animations associated with said outcomes; and displaying said outcomes.

16. The method of claim 14, wherein evaluation of a criterion being fulfilled comprises at least one of evaluating reception of a signal and evaluating an outcome against said criterion.

17. The method of claim 14, wherein the step of placing the bonus feature in a suspended state comprises storing data bonus-feature data representative of the suspended state.

18. The method of claim 14, wherein the step of assigning an award to the player comprises awarding the player with an award medium according to the play-assigned award.

19. A gaming device for providing an interdependent combination of a primary game and a bonus feature to a player, the gaming device comprising:

input-receiving means for receiving player inputs from the player;

displaying means for displaying information regarding at least one of a primary game, a resumed primary game and a bonus feature being conducted; and controlling means for controlling providing of the primary game, the resumed primary game and the bonus feature on the displaying means according to player inputs, the controlling means being adapted for:

providing a primary game outcome to the player;

evaluating fulfillment of winning criteria and of a bonus-feature initiation criterion;

assigning an award to the player according to the primary game outcome;

placing the primary game in a suspended state and signaling an initiation of a bonus feature upon the bonus-feature initiation criterion being fulfilled;

upon signaling of the initiation of the bonus feature, providing a bonus feature process resulting in a plurality of feature outcomes;

maintaining the bonus feature in a suspended state when a feature outcome fulfills a primary-game ticket criterion;

signaling a bonus-feature resuming criterion to the player; and resuming providing the primary game to the player by generating a resumed primary game outcome while the bonus feature remains in the suspended state until evaluating the resumed primary game outcome results in the fulfillment of the bonus-feature resuming criterion, after which the controlling means resumes providing the bonus feature.

20. The gaming device of claim 19, further comprising communicating means for communicating with a remote server providing the gaming device with at least one of outcome signals, bonus-feature related signals, and player-account related signals.

21. The gaming device of claim 19, further comprising awarding means for awarding the player with award media according to player-assigned awards.

* * * * *